US006512910B2

(12) United States Patent
Aoki et al.

(10) Patent No.: US 6,512,910 B2
(45) Date of Patent: Jan. 28, 2003

(54) DEVELOPING APPARATUS

(75) Inventors: Shinji Aoki, Yokohama (JP); Takao Izumi, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/817,207

(22) Filed: Mar. 27, 2001

(65) Prior Publication Data

US 2002/0172535 A1 Nov. 21, 2002

(51) Int. Cl.[7] ..... G03G 15/08
(52) U.S. Cl. ..... 399/276; 399/286
(58) Field of Search ..... 399/286, 267, 399/276

(56) References Cited

U.S. PATENT DOCUMENTS 5,697,029 A * 12/1997 Saitoh et al. ..... 399/286
6,430,384 B2 * 8/2002 Hama et al. ..... 399/276

FOREIGN PATENT DOCUMENTS

JP 4-88375 * 3/1992
JP 9-50178 * 2/1997

* cited by examiner

*Primary Examiner*—Quana M. Grainger
(74) *Attorney, Agent, or Firm*—Foley & Lardner

(57) ABSTRACT

The developing sleeve comprising a metal substrate and a ceramic-dispersion-plated metal film containing ceramic particles dispersed therein and formed on a surface of the metal substrate. The developing apparatus is equipped with this developing sleeve and the image forming apparatus has this developing apparatus.

12 Claims, 2 Drawing Sheets

DEVELOPING APPARATUS

BACKGROUND OF THE INVENTION

The present invention relates to a developing sleeve used in a developing apparatus of an image forming device of a type in which electrophotography is applied, such as a photocopier or a printer, a developing apparatus which is equipped with the developing sleeve, and an image forming device equipped with the developing apparatus.

The developing apparatus of an electrophotographic device comprises a developing sleeve generally made of a metal or rubber, for carrying a toner, charging it and conveying it to a photoreceptor. In the case of a metal-made developing sleeve, the surface of the sleeve is subjected to a sandblast treatment to impart an appropriate surface roughness.

However, the conventional metal-made developing sleeves entail the following drawbacks.

That is, in each of the conventional developing sleeves, the sandblast treatment is carried out on their surface in order to impart a certain roughness thereto, thus obtaining a toner conveying ability. However, in the case where it is made of a metal such as stainless steel, the surface is made very hard, and therefore it is very difficult to carry out the sandblast treatment. Further, in the case where Al is used for the sleeve substrate, the surface is made soft and therefore it is easy to carry out the sandblast treatment. However, the surface has a poor anti-abrasiveness and therefore a problem of durability occurs.

BRIEF SUMMARY OF THE INVENTION

It is an object of the present invention to provide a developing sleeve having an excellent developer conveying ability and an excellent durability even without carrying out a sand-blast treatment or the like on its surface.

It is another object of the present invention to provide a developing apparatus equipped with a developing sleeve having an excellent developer conveying ability and an excellent durability.

It is still another object of the present invention to provide an image forming apparatus including such a developing apparatus, which can maintain a sufficient image density in a long period of operation.

According to the present invention, there is provided a developing sleeve comprising a metal substrate of a sleeve shape; and a ceramic-dispersion-plated metal film containing ceramic particles dispersed therein and formed on a surface of the metal substrate.

Further, according to the present invention, there is provided a developing apparatus comprising a container containing a developing agent; a developing sleeve described above, provided in the container; a supplier, provided in the container, for supplying the developing agent to the developing sleeve; and a regulating member regulating a thickness of a film of the developing agent, carried on the surface of the developing sleeve.

Still further, according to the present invention, there is provided an image forming apparatus comprising a photoreceptor; a charger charging a surface of the photoreceptor; an exposing device exposing the surface of the photosensitive, which is charged, thereby forming an electrostatic latent image thereon; a developing apparatus described above, provided to face the photoreceptor, for developing the latent image, thereby forming a developing agent image; and a transfer device for transferring the developing agent image onto a transfer medium.

BRIEF DESCRIPTION OF THE SEVERAL VIEW OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The developing sleeve of the present invention is featured in that the surface of a sleeve substrate is dispersion-plated using a plating bath containing ceramic particles dispersed therein, thus making an appropriately rough surface. In this manner, the following features can be achieved, that is, the conveying capability of one-component developing agent can be improved, and the mechanical strength and durability of the sleeve can be improved.

Figure 1:
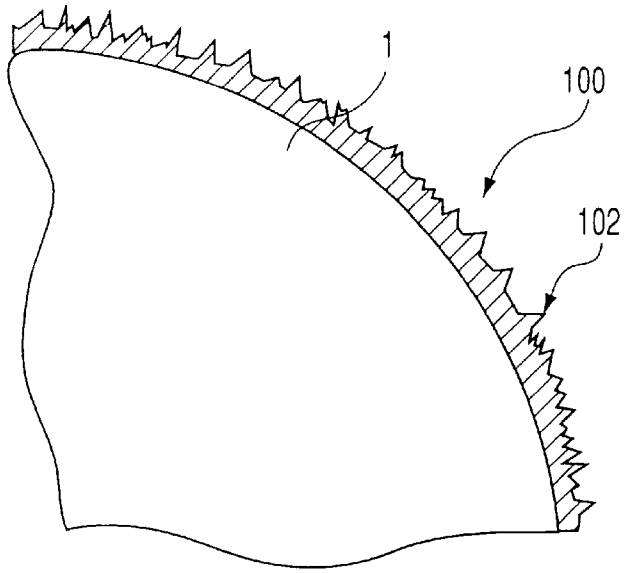
FIG. 1 is a cross sectional view of a developing sleeve according to an embodiment of the present invention.

FIG. 1 is a cross sectional view showing the surface portion of the developing sleeve according to an embodiment of the present invention. A developing sleeve 100 of this embodiment is prepared by the following manner. That is, a sleeve-shaped metal member 1 serving as a sleeve substrate is subjected to a ceramic dispersion plating treatment using a plating bath containing ceramic particles dispersed therein, so as to plate the surface of the metal member.

Examples of the material for the developing sleeve substrate are metals such as Al, Cu and stainless steel. Examples of the material for the ceramic powder are silica, alumina, titania and silica-alumina. It should be noted that when silica is used as the ceramic powder, it is preferable that the surfaces of silica particles are subjected to an amino silane coupling treatment in advance.

It is preferable that the average grain diameter of the ceramic particles should be in a range of 0.1 to 10.0 $\mu$m. If the average diameter of the ceramic particles is less than 0.1 $\mu$m, there is a tendency that the coarseness of the surface of the developing sleeve becomes low, thus lowering the toner conveying ability, whereas if it exceeds 10.0 $\mu$m, the roughness of the surface of the developing sleeve becomes excessively high, thus excessively raising the toner conveying ability.

Examples of the plating metal which can be used in the dispersion plating are Ni, Zn and Cu.

The dispersion plating conditions for the electrolytic plating using a plating bath containing ceramic particles dispersed therein, are as follows.

Cathode: Sleeve substrate

Temperature of Plating Bath: 20 to 40° C.

Ceramic Particle Contents in Plating Bath: 10 to 300 g/cm$^3$

Metal Ion Concentration of Plating Bath: 1 to 10 mol/dm$^3$

Initial pH value of Plating Bath: 2 to 5

Current Density: 5 to 50 mA/cm$^2$

When an electrolytic dispersion plating is carried out with the above-listed conditions, a plated film having a thickness of 4 to 30 $\mu$m and a ceramic content of 2 to 20 mass % can be obtained.

If the thickness of the plated film is less than 4 $\mu$m, the effects of the present invention cannot be obtained, whereas if it exceeds 30 $\mu$m, it is difficult to form a plated film.

Further, the ceramic content of the plated film is less than 2 mass %, the effects of the present invention cannot be obtained, whereas if it exceeds 20 mass %, it is difficult to form a plated film.

It should be noted that as another dispersion plating method, a conventional technique of non-electrolytic dispersion plating using, for example, Ni-P can be employed.

The surface roughness of thus obtained dispersion-plated film should preferably be Rz 1 to 5.

If Rz is less than 1, there is a tendency that the toner conveying ability becomes low, whereas if Rz exceeds 5, the toner conveying ability becomes excessively high.

Figure 2:
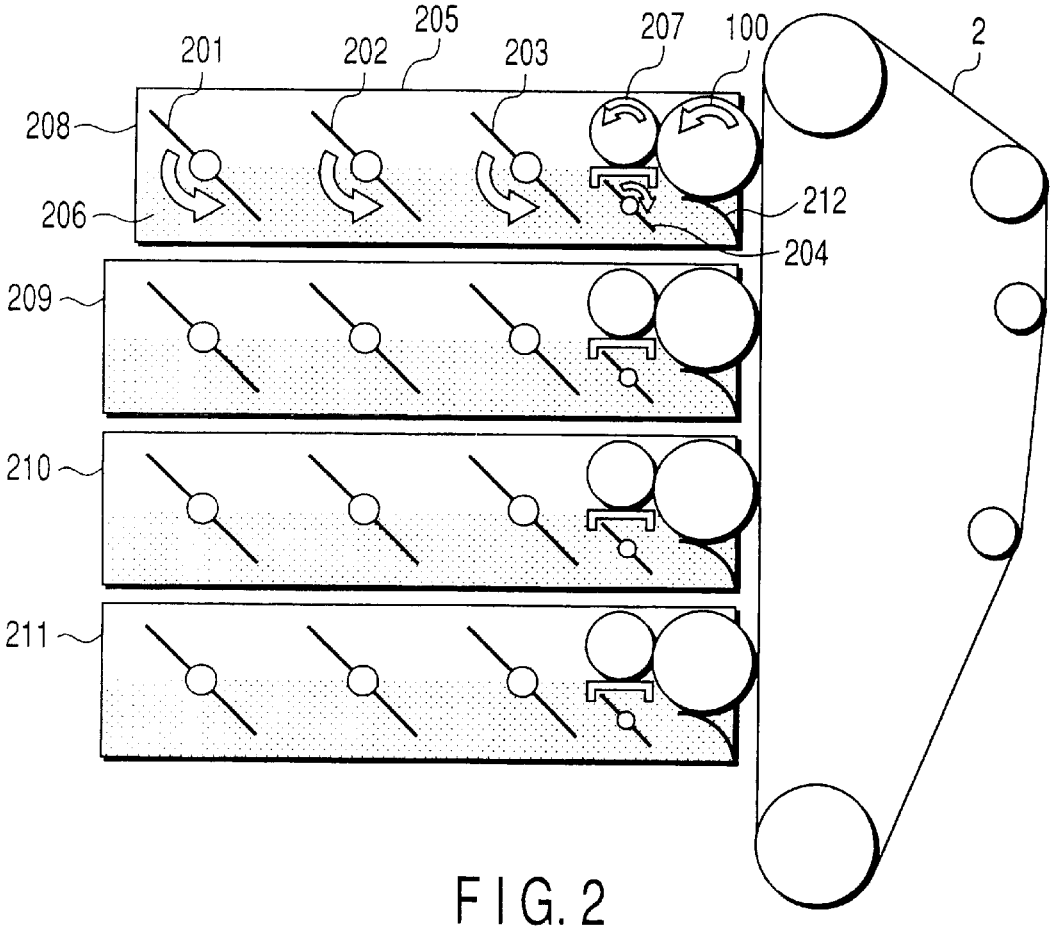
FIG. 2 is a cross sectional view schematically showing a developing apparatus equipped with the developing sleeve according to the embodiment of the present invention.
Figure 3:
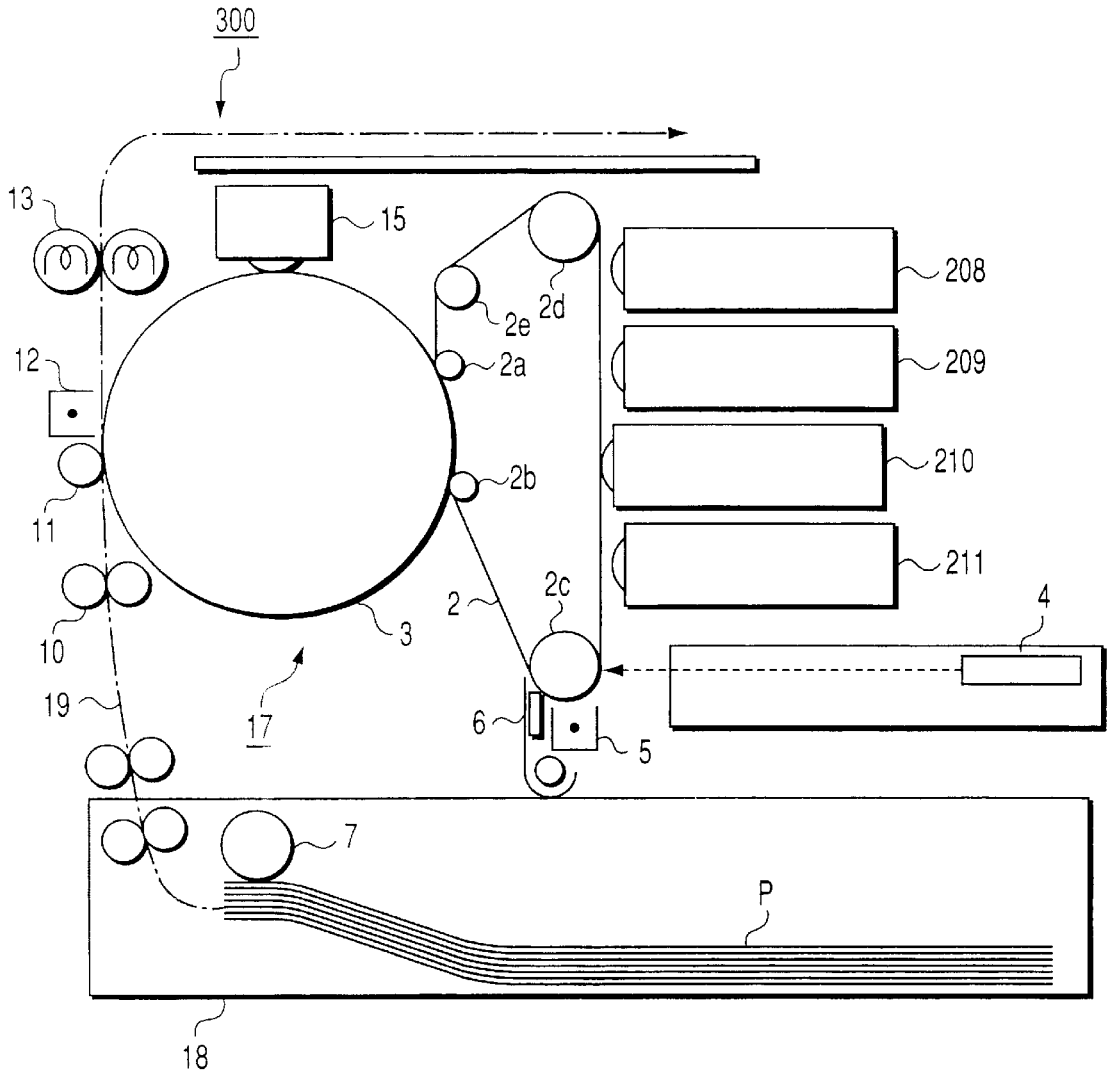
FIG. 3 is a cross sectional view showing an image forming apparatus including the developing apparatus equipped with the developing sleeve according to the embodiment of the present invention.

The developing sleeve described above is built in each of developing apparatus 208 to 211 shown in FIG. 2, and the developing apparatus 208 to 211 are used in an image forming apparatus 300 shown in FIG. 3.

TABLE 1 presents evaluations of output images in terms of initial image density and durability, obtained in development tests carried out using the image forming apparatus 300 shown in FIG. 3, which includes the developing apparatus shown in FIG. 2 each equipped with the developing sleeve manufactured in this embodiment. It should be noted that TABLE 1 additionally shows data of conventional developing sleeves (an untreated product of a stainless steel-made developing sleeve and a sand-blast treated product of a stainless steel/Al-made developing sleeve).

The developing operation is carried out continuously for 30 hours at a developing roller circumferential speed of 250 mm/s. The initial image density was evaluated to be good if it was 1.6 or higher, and to be no good if it was less than 1.6. The durability was evaluated to be good if the image density after the test was 1.5 or higher, and no good if the image density was less than 1.5.

The image density was measured with use of Macbeth reflection density meter RD918 (trade name).

The developing apparatus and image forming apparatus used in the developing operation test will now be described with reference to FIGS. 2 and 3.

FIG. 2 is a diagram schematically showing developing apparatus each equipped with a developing sleeve according to an embodiment of the present invention. As shown in FIG. 2, each of developing apparatus 208 to 211 has a structure in which three conveying springs 201 to 203, one collection-stirring paddle 204, a separation-supply roller 207 and a developing sleeve 100 are provided in a housing 205. Non-magnetic one-component toner 206 is contained in the housing 205.

The non-magnetic one-component toner 206 contained in the housing 205 is carried on the developing sleeve 100 by the separation-supply roller 207. The thickness of a layer of the toner 206 is regulated by a regulating blade 212, and a latent image on a photoreceptor 2 is developed.

FIG. 3 is a diagram schematically showing an image forming apparatus equipped with the developing apparatus 208 to 211 shown in FIG. 2. The image forming apparatus 300 shown in FIG. 3 includes a photoreceptor 2 in the form of an endless belt, a charging device 5 charging the photoreceptor 2 at a predetermined potential, an exposure device 4 forming an electrostatic latent image on the charged photoreceptor 2, first to fourth developing apparatus 208 to 211 each supplying toner to the latent image formed on the photoreceptor 2 by the exposure device 4 so as to visualize the latent image, an intermediate transfer member 3 temporarily holding a toner image formed on the photoreceptor 2 by each of the developing apparatus 208 to 211, an intermediate transfer member cleaner 15 cleaning the intermediate transfer member 3 and a cleaning device 6 removing remaining toner on the photoreceptor 2, which form an image forming unit 17.

The photoreceptor 2 is brought into tight contact with the outer circumferential surface of the intermediate transfer member 3 by means of first and second rollers 2*a* and 2*b*. At the same time, the member 2 is supported by third and fourth rollers 2*c* and 2*d*, as well as a fifth roller 2e while a predetermined tension is being applied thereto such as to maintain the intervals between these developing apparatus at constant. Further, the photoreceptor 2 is rotated in the direction indicated by an arrow at a predetermined speed by the rotation of a motor (not shown) of any one of the rollers. Underneath the image forming unit 17, a sheet cassette 18 holding sheets (output materials) P having a predetermined size is provided.

The sheet cassette 18 is provided with a sheet feeding roller 7 feeding out sheets contained in the cassette one by one. Between the sheet cassette 18 and the intermediate transfer member 3, a conveying system 19 conveying sheets towards the intermediate transfer member 3 is provided.

An image transfer roller 11 transferring the toner image formed on the intermediate transfer member 3 is provided in the conveying system 19 at a position where the intermediate transfer member 3 and a conveyed sheet P meet to contact with each other. It should be noted that on an upstream side (on the cassette 18 side) of the transfer roller 11, an aligning roller 10 is provided, which temporarily stops a sheet P being conveyed by the conveying system 9 in order to correct the inclination of the sheet p with respect to the conveying direction and to place the leading end of the sheet P to coincide with the leading end of the toner image on the intermediate transfer member 3. On an downstream side of the transfer roller 11, there are provided a separating device 12 for applying an AC charge so as to separate the sheet P on which the toner image has been transferred, from the intermediate transfer member 3, and a fixing device 13 for fixing the toner image transferred on the sheet P, on the sheet P.

Next, the full-color printing operation of the image forming apparatus shown in FIG. 3 will now be described.

First, the surface of the rotating photoreceptor 3 is charged uniformly by the charging device 5. Then, an exposure for a yellow image is carried out on the photoreceptor 2 by the exposure device 4, so as to form an electrostatic latent image thereon. Next, the latent image on the photoreceptor 2 is developed with yellow toner by the yellow developing apparatus 208, and further, the developed image is transferred onto the intermediate transfer member 3.

After the transfer operation, the photoreceptor 2 separated from the intermediate transfer member 3 is discharged photoelectrically by a discharger (charge canceller). The remaining toner on the photoreceptor 2, left out after being not transferred to the intermediate transfer member 3, is cleaned by the photoreceptor cleaner 6. The toner cleaned is collected in a waste toner box.

Next, the photoreceptor 2 is re-charged by the charging device 5, and then an exposure for a magenta image is carried out by the exposure device 4, thus forming an electrostatic latent image. Then, the latent image on the photoreceptor 2 is developed with magenta toner by the magenta developing apparatus 209. Further, the magenta toner image is transferred as it is overlaid on the yellow image already formed on the intermediate transfer member 3. With regard to a cyan image and a black image, the same step is carried out, and thus a four-color overlaid image is formed on the intermediate transfer member 3. After that, a sheet P is fed between the intermediate transfer member 3 and the transfer roller 11, and the four-color overlaid toner image is secondarily transferred on the sheet in batch. The sheet which holds the four-color toner image is separated from the intermediate transfer member 3 by the separation charger 12, and conveyed to reach the fixing device 13, where a color image of fixed toner is obtained.

In the meantime, some of the toner remains to be left out as being not transferred on the sheet, on the intermediate transfer member 3. Therefore, after the completion of the secondary transfer operation, the Ad intermediate transfer member cleaner 15 is brought into contact with the member 3 so as to clean the intermediate transfer member 3. It should be noted that while the above-described four-color overlaid image is being formed on the intermediate transfer member 3, the intermediate transfer member cleaner 15 is located being separated from the intermediate transfer member 3.

Subsequently, silica powder having an average grain diameter of 1 $\mu$m, which was subjected to silane coupling treatment with 3-[2-(2-aminoethylamino)ethylamino] propyltrimethoxysilane, was dispersed at a concentration of 50 g/dm$^3$ in a plating bath containing $ZnSO_4$ at 1 mol/dm$^3$ and $H_3BO_3$ at 0.5 mol/dm$^3$. Then, the pH value of the bath was adjusted with diluted sulfuric acid to 4. After that, while mixing and stirring the bath, a constant-current electrolytic plating treatment was carried out for one hour at a current density of 10 mA/cm$^2$ and a temperature of 25° C.

The surface of the roller base member 201 which was subjected to the electrolytic plating treatment was cleaned sufficiently with distilled water, and thus a developing sleeve was obtained. The thickness of the plated film formed on the surface was 12 $\mu$m and the silica content in the plated film was 3 to 5 mass %.

The developing sleeve thus obtained after the ceramic dispersion plating treatment had a toner carrying ability similar to that of the conventional roller which was obtained by subjecting an Al-made sleeve substrate to a sandblast treatment. Further, even after a developing apparatus equipped with this developing sleeve was driven continuously for 30 hours at a developing roller circumferential speed of 250 mm/s, a decrease in the image density was not observed.

TABLE 1

| | | Ceramic | | | | | |
|---|---|---|---|---|---|---|---|
| | | Average diameter [$\mu$m] | Silane coupling treatment | Plate Metal | Plate Thickness [$\mu$m] | Initial image density | Durability |
| Present invention | $SiO_2$ | 1 | treated | Ni | 12 | good | good |
| | $SiO_2$ | 1 | not-treated | Zn | 12 | good | good |
| | $Al2O_3$ | 1 | not-treated | Ni | 12 | good | good |
| Prior art | | | SUS unprocessed | | | no good | no good |
| | | | SUS/sandblast treatment | | | no good | good |
| | | | Al/sandblast treatment | | | good | no good |

As presented in TABLE 1 above, it is understood that the developing sleeve of the present invention exhibits excellent performances in both of the initial image density and durability. In the developing sleeve of the present invention, the surface roughness can be controlled by changing the conditions of the electrolysis and the particle diameter of the ceramic powder. Therefore, it becomes possible to provide a developing roller which corresponds to the properties of the toner used.

Specific examples of the present invention will now be provided in order to explain the present invention in more detail.

EXAMPLE 1

The surface of a roller base member 201 made of Cu alloy was degreased with acetone and an alkali aqueous solution, and then the member was immersed in a $HNO_3$ aqueous solution having a concentration of 5 mol/dm$^3$, so as to chemically polishing the surface of the roller base member 201.

EXAMPLE 2

The surface of a Cu alloy-made roller base member 201 was cleaned (degreased) with acetone and an alkali aqueous solution, and then the member was immersed in a $HNO_3$ aqueous solution having a concentration of 5 mol/dm$^3$, so as to chemically polishing the surface of the roller base member 201.

Subsequently, silica powder having an average grain diameter of 1 $\mu$m was dispersed at a concentration of 100 g/dm$^3$ in a plating bath containing $NiSO_4$ at 1 mol/dm$^3$ and $H_3BO_3$ at 0.5 mol/dm$^3$. Then, the pH value of the bath was adjusted with diluted sulfuric acid to 3. After that, while mixing and stirring the bath, a constant-current electrolytic plating treatment was carried out for 60 minutes at a current density of 10 mA/cm$^2$ and a temperature of 25° C.

Lastly, the surface of the roller base member 201 which was subjected to the electrolytic plating treatment was cleaned sufficiently with distilled water, and thus a developing sleeve was obtained. The thickness of the plating film formed on the surface was 12 μm and the silica content in the plating film was 3 to 5 mass %.

The developing sleeve thus obtained after the ceramic dispersion plating treatment had a toner carrying ability similar to that of the conventional roller which was obtained by subjecting an Al-made sleeve substrate to a sandblast treatment. Further, even after a developing apparatus equipped with this developing sleeve was driven continuously for 30 hours at a developing roller circumferential speed of 250 mm/s, a decrease in the image density was not observed.

EXAMPLE 3

The surface of a roller base member 201 made of Cu alloy was degreased with acetone and an alkali aqueous solution, and then the member was immersed in a $HNO_3$ aqueous solution having a concentration of 5 mol/dm$^3$, so as to chemically polishing the surface of the roller base member 201.

Subsequently, alumina powder having an average grain diameter of 1 μm was dispersed at a concentration of 100 g/dm$^3$ in a plating bath containing $NiSO_4$ at 1 mol/dm$^3$ and $H_3BO_3$ at 0.5 mol/dm$^3$. Then, the pH value of the bath was adjusted with diluted sulfuric acid to 3. After that, while mixing and stirring the bath, a constant-current electrolytic plating treatment was carried out for 60 minutes at a current density of 10 mA/cm$^2$ and a temperature of 25° C.

Lastly, the surface of the roller base member 201 which was subjected to the electrolytic plating treatment was cleaned sufficiently with distilled water, and thus a developing sleeve was obtained. The thickness of the plating film formed on the surface was 12 μm and the alumina content in the plating film was 3 to 5 mass %.

The developing sleeve thus obtained after the ceramic dispersion plating treatment had a toner carrying ability similar to that of the conventional roller which was obtained by subjecting an Al-made sleeve substrate to a sandblast treatment. Further, even after a developing apparatus equipped with this developing sleeve was driven continuously for 30 hours at a developing roller circumferential speed of 250 mm/s, a decrease in the image density was not observed.

As described above, with the developing sleeve of the present invention, which is obtained by subjecting the surface of the metal-made roller substrate to the ceramic dispersion plating, the toner carrying ability and durability can be significantly increased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing sleeve comprising:

a metal substrate of a sleeve shape; and a ceramic-dispersion-plated metal film containing ceramic particles dispersed therein and formed on a surface of the metal substrate.

2. A developing sleeve according to claim 1, wherein the ceramic powder have an average particle diameter of 0.1 to 10 μm.

3. A developing sleeve according to claim 1, wherein the ceramic powder is at least one selected from the group consisting of silica powder, alumina powder, titania powder and silica-alumina powder.

4. A developing sleeve according to claim 1, wherein the ceramic powder is silica powder which has been subjected to an aminosilane coupling treatment.

5. A developing sleeve according to claim 1, wherein a metal of the metal coating film is at least one selected from the group consisting of Ni, Zn and Cu.

6. A developing sleeve according to claim 1, wherein the ceramic-dispersion-plated metal coating film is a plated film which is formed by a dispersion plating treatment using a plating bath containing ceramic powder.

7. A developing sleeve according to claim 1, wherein a content of the ceramic powder in the metal coating film is 2 to 20 mass %.

8. A developing sleeve according to claim 1, wherein a thickness of the metal coating film is 4 to 30 μm.

9. A developing sleeve according to claim 1, wherein a surface coarseness of the metal coating film is Rz 1 to 5 μm.

10. A developing sleeve according to claim 1, wherein a metal of the metal substrate is one selected from the group consisting of aluminum, copper and stainless steel.

11. A developing apparatus comprising:

a container containing a developing agent;

a developing sleeve according to claim 1, provided in the container;

a supplier, provided in the container, for supplying the developing agent to the developing sleeve; and a regulating member regulating a thickness of a film of the developing agent, carried on the surface of the developing sleeve.

12. An image forming apparatus comprising:

a photoreceptor;

a charger charging a surface of the photoreceptor;

an exposing device exposing the surface of the photosensitive, which is charged, thereby forming an electrostatic latent image thereon;

a developing apparatus according to claim 11, provided to face the photoreceptor, for developing the latent image, thereby forming a developing agent image; and a transfer device for transferring the developing agent image onto a transfer medium.

* * * * *